US007018264B2

(12) United States Patent
Foster et al.

(10) Patent No.: US 7,018,264 B2
(45) Date of Patent: Mar. 28, 2006

(54) ROLLING VEHICLE THAT LAUNCHES A FLYING VEHICLE

(75) Inventors: George T. Foster, Long Beach, CA (US); Joseph Cernansky, Palos Verdes Estates, CA (US); Ian B. Osborne, Gardena, CA (US); Steve Conrad, Redondo Beach, CA (US)

(73) Assignee: Elliot Rudell, Torrance, CA (US)

( * ) Notice: Subject to any disclaimer, the term of this patent is extended or adjusted under 35 U.S.C. 154(b) by 20 days.

(21) Appl. No.: 10/636,165

(22) Filed: Aug. 6, 2003

(65) Prior Publication Data

US 2004/0116044 A1 Jun. 17, 2004

Related U.S. Application Data

(60) Provisional application No. 60/422,035, filed on Oct. 28, 2002.

(51) Int. Cl.
*A63H 17/045* (2006.01)

(52) U.S. Cl. ..... 446/435; 446/454; 446/456

(58) Field of Classification Search ..... 446/435, 446/398–401, 405, 473, 456, 454
See application file for complete search history.

(56) References Cited

U.S. PATENT DOCUMENTS 4,579,298 A * 4/1986 Thomson ..... 244/3.21
5,347,910 A * 9/1994 Avila et al. ..... 89/41.22
5,597,165 A 1/1997 Rundle et al.
5,842,907 A * 12/1998 Niimura et al. ..... 446/435

FOREIGN PATENT DOCUMENTS

DE 4118330 A1 * 12/1992
EP 700703 A2 * 3/1996
JP 08309038 A * 11/1998

OTHER PUBLICATIONS

"TYCO® R/C 6.0V Jet Turbo Python", p. 7, no date.
"TYCO® R/C 6.0V Jet Turbo Fire Power", p. 6, no date.
"Air Vectors Self-Transforming Vehicles", no date, 2 pages.

* cited by examiner

*Primary Examiner*—Kien Nguyen

(74) *Attorney, Agent, or Firm*—Ben J. Yorks; Irell & Manella LLP

(57) ABSTRACT

A remote controlled toy. The toy includes a powered projectile that can be launched from a remote controlled vehicle. The powered projectile and remote controlled vehicle may each have a motor controlled by a radio frequency ("RF") transmitter. The projectile can be shaped as an airplane that is loaded into a launch platform of the remote controlled vehicle. The user can control movement of the vehicle with the RF transmitter. The transmitter may have a launch button that is depressed by the user to launch the airplane. While in flight the user can control the airplane through the RF transmitter. The motor of the vehicle may turn off when the airplane is launched.

23 Claims, 4 Drawing Sheets

ROLLING VEHICLE THAT LAUNCHES A FLYING VEHICLE

REFERENCE TO CROSS-RELATED APPLICATION

This application claims priority to provisional Application No. 60/422,035 filed on Oct. 28, 2002.

BACKGROUND OF THE INVENTION

1. Field of the Invention

The subject matter disclosed generally relates to a remote controlled toy set.

2. Background Information

There have been marketed a number of different remote controlled toys. Remote controlled toys typically include a vehicle that contains a battery, a motor and a radio frequency (RF) receiver. A user can control the movement and direction of the vehicle through an RF transmitter. By way of example, there have been marketed remote controlled toy cars, toy trucks, toy military vehicles and toy airplanes.

There have also been marketed toys that eject projectiles. For example, there was marketed a projectile ejecting toy under the trademark AIR VECTORS by YES! Entertainment. AIR VECTORS were spring powered toy vehicles that would eject a project after a predetermined time interval.

Tyco marketed a remote controlled toy under the trademark FIREPOWER that launched foam "missiles" when a button on the transmitter was depressed. Tyco also marketed a remote controlled toy under the trademark PYTHON that sprayed water in response to the depression of a button on a transmitter.

U.S. Pat. No. 5,842,907 issued to Niimura et al. discloses a remote controlled vehicle that can launch a non-powered projectile in response to a remote signal. None of the prior art discloses a remote controlled vehicle that launches a projectile that is powered after ejection from the vehicle. The prior art also does not include a remote controlled vehicle that can launch a toy airplane.

BRIEF SUMMARY OF THE INVENTION

A toy set that includes a remote controlled vehicle and a powered projectile. The remote controlled vehicle is coupled to a remote controlled transmitter. The powered projectile is coupled to the remote controlled vehicle.

DETAILED DESCRIPTION

Disclosed is a remote controlled toy. The toy includes a powered projectile that can be launched from a remote controlled vehicle. The powered projectile and remote controlled vehicle may each have a motor controlled by a radio frequency ("RF") transmitter. The projectile can be shaped as an airplane that is loaded into a launch platform of the remote controlled vehicle. The user can control movement of the vehicle with the RF transmitter. The transmitter may have a launch button that is depressed by the user to launch the airplane. While in flight the user can control the airplane through the RF transmitter. The motor of the vehicle may turn off when the airplane is launched.

Figure 1:
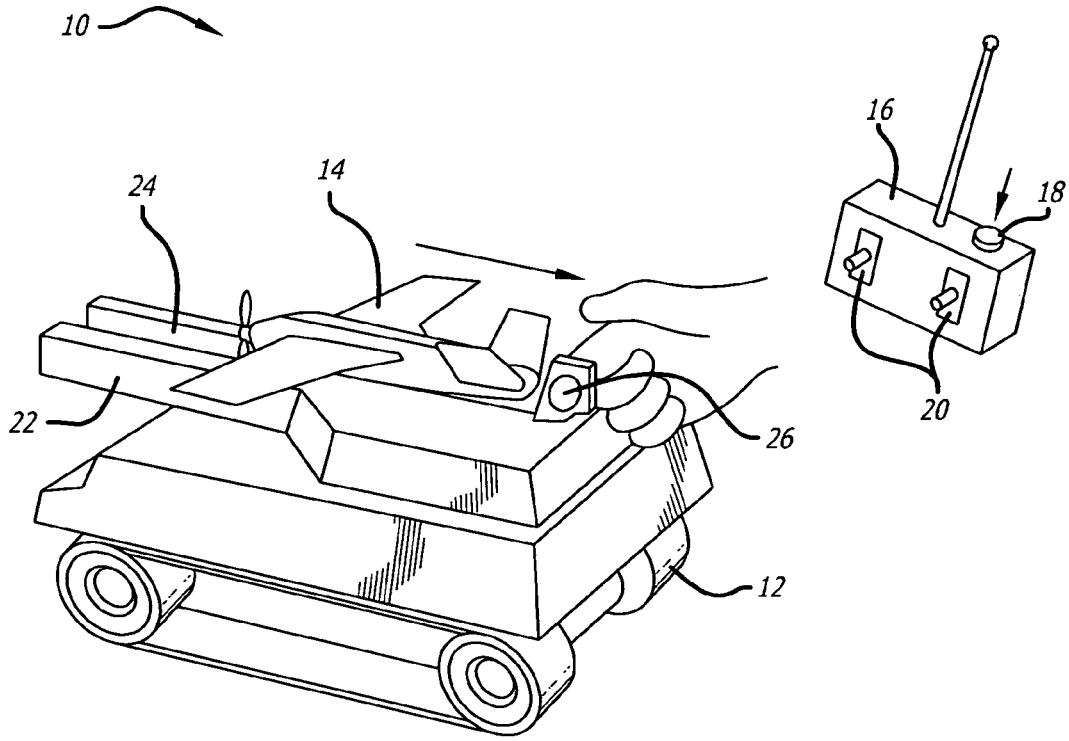
FIG. 1 is an illustration of an embodiment of a toy set.

Referring to the Figures more particularly by reference numbers, FIG. 1 shows a radio controlled toy 10. The toy 10 includes a remote controlled vehicle 12, a power projectile 14 and an RF transmitter 16. The projectile 14 may be configured as a toy airplane. The RF transmitter 16 may have a launch button 18 and a pair of control levers 20. The launch button 18 can be depressed to launch the airplane 14 from the vehicle 12. The control levers 20 can be moved to control the movement of the vehicle 12 and the flight of the airplane 14. The transmitter 16 may transmit control signals to the vehicle 12 with one frequency and transmit signals to the plane 14 with a different frequency. Alternatively, the vehicle 12 and plane 14 may receive control signals at the same frequency. Although a RF transmitter 16 is described, it is to be understood that the transmitter 16 may transmit other types of wireless signals such as infrared.

Figure 2:
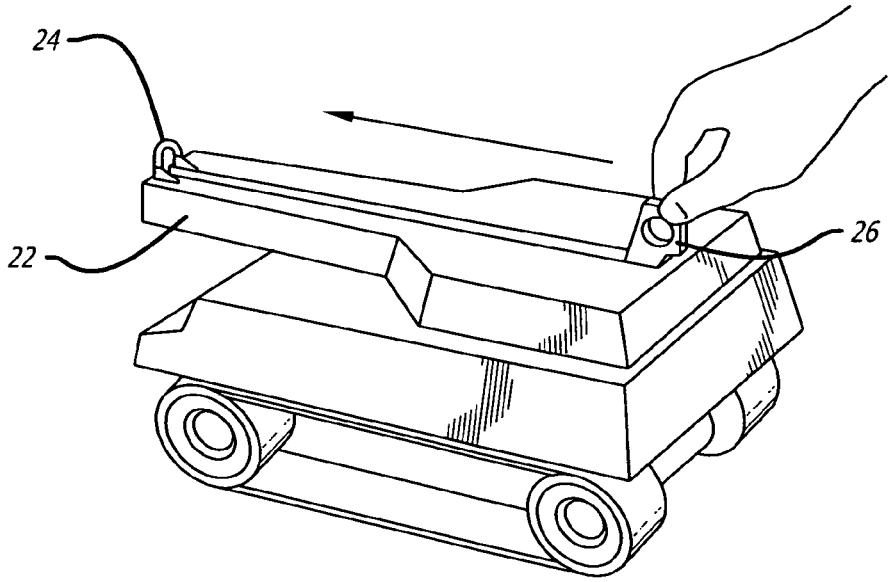
FIG. 2 is an illustration showing a launch platform of a remote controlled vehicle being set to a locked position.
Figure 3:
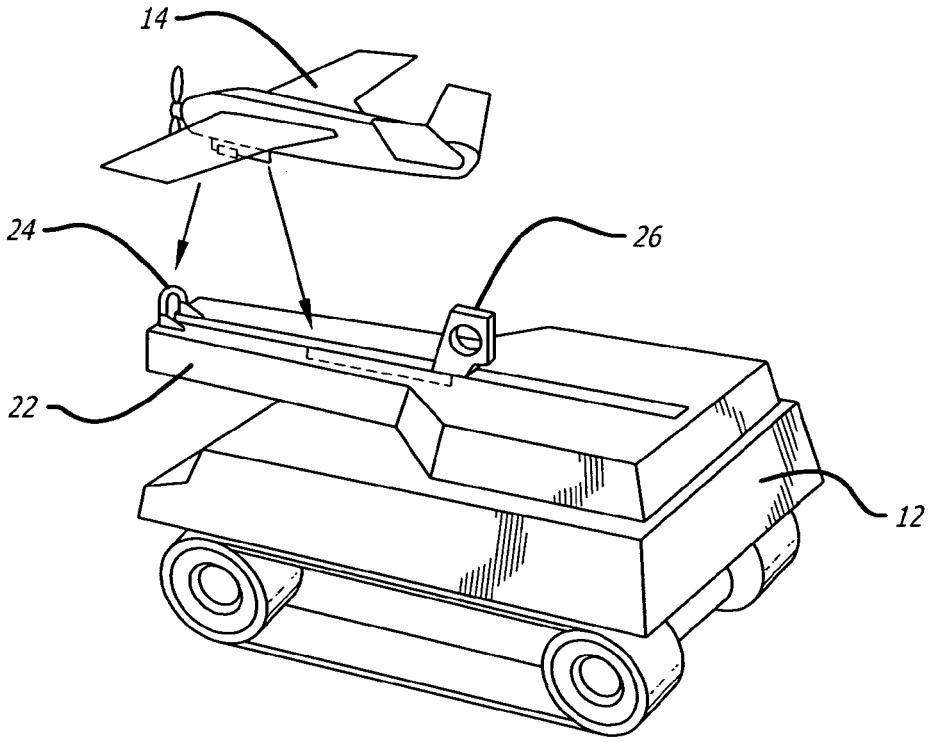
FIG. 3 is an illustration showing a toy airplane being loaded onto the launch platform.

The vehicle 12 may have a launch platform 22 that launches the airplane 14. The launch platform 22 may include a rubber band 24 or other energy storing device connected to a tab ring 26. As shown in FIGS. 2 and 3, the tab ring 26 may be pulled to a locked position to allow the airplane 14 to be mounted to the launch platform 22. The tab ring 26 may be locked in placed by a latch (not shown). The airplane 14 may have hinged wings that can be folded to reduce the wingspan of the plane.

Figure 4:
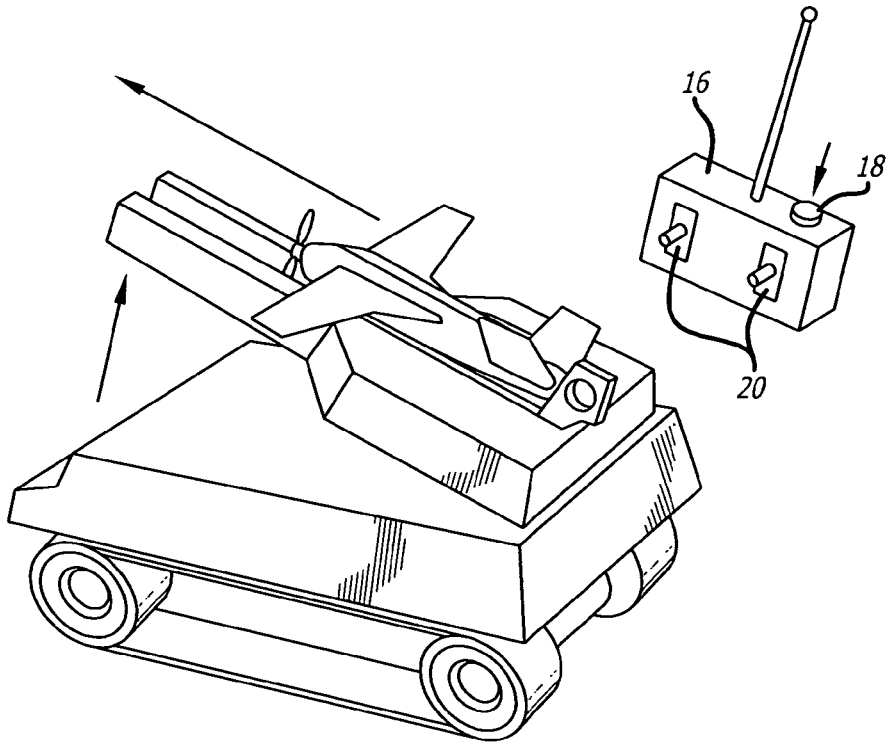
FIG. 4 is an illustration showing the launch platform in a launch position.

Referring to FIG. 4, when the launch button 18 is depressed, the transmitter 16 sends a radio signal that causes the launch platform 22 to pivot and launches the plane 14. The vehicle 12 may have a mechanism and actuator (not shown) to automatically tilt the platform when the launch button 18 is depressed and moves back down when the plane 14 is launched.

Figure 5:
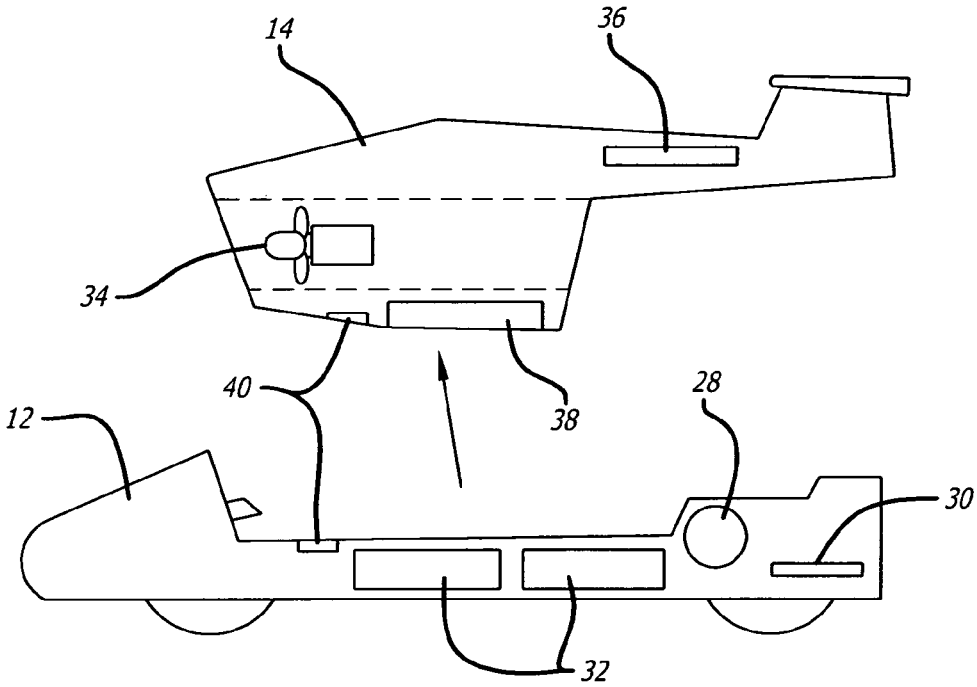
FIG. 5 is an illustration showing the internal components of the remote controlled vehicle and toy airplane.

As shown in FIG. 5, the remote controlled vehicle 12 may have a motor 28 that moves the vehicle 12. The motor 28 may be coupled to a RF receiver 30 that receives RF signals from the transmitter 16. The movement of the vehicle 12 is controlled through the levers 20 of the transmitter 16 (see FIG. 1). The vehicle 12 may have a battery(ies) 32 to power the motor 28.

The airplane 14 may have one or more motors 34 and accompanying propellers to propel the vehicle 14. The motors 34 may be coupled to a RF receiver 36 that receives RF signals from the transmitter 16. The flight of the vehicle 14 may be controlled by the same transmitter levers 20 that control the vehicle 12.

The airplane 14 may have two motors 34, one on each side. Turning off one motor will cause the flying vehicle to turn in the direction of or reduce the speed of the powered down motor. Depressing one lever 20 of the transmitter 16 may turn off a motor and cause the plane to turn. The motor 34 may be powered by a rechargeable power supply 38. The power supply 38 may be a battery or a capacitor(s). Using a capacitor as the power supply may reduce the weight of the airplane 14. The airplane 14 may contain a battery sensor (not shown) that prevents a launch of the plane if the battery power is too low. The remote controlled vehicle 12 may contain an attitude sensor (not shown) that prevents a launch if the vehicle attitude is below a certain position.

The vehicle 12 and airplane 14 may each have contacts 40. When the contacts 40 are in contact the RF signals from the transmitter 16 move the vehicle 12. When the contacts 40 are not in contact the motor 28 is deactivated and the vehicle 12 stops. The motor 34 of the airplane 14 are then activated, wherein the RF signals of the transmitter 16 control the flight of the plane 14.

Figure 6:
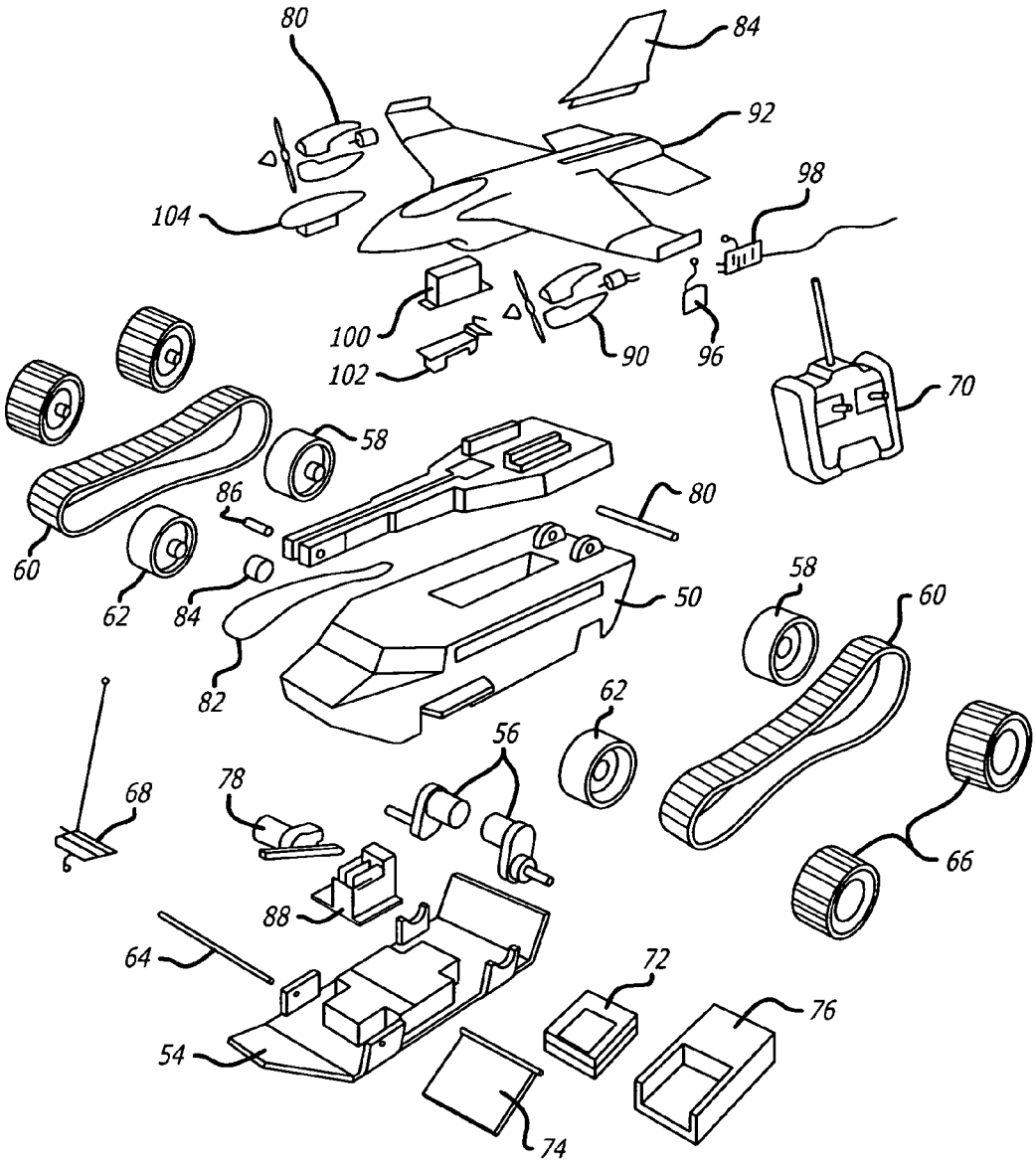
FIG. 6 is an exploded view of an embodiment the toy set.

FIG. 6 shows an embodiment of a radio controlled toy. The vehicle may include a top vehicle housing 50 that supports a housing platform 52 and is attached to a bottom cover 54. Within the housing 50 is a pair of motors 56 that are attached to a pair of rear rollers 58. The rear rollers 58 are coupled to a pair of tracks 60. The tracks 60 roll about the rear roller 58 and a pair of front rollers 62. The front rollers 62 are coupled to the housing by axles 64. Alternatively, the motors 56 can be coupled to wheels 66 instead of the tracks 60 and rollers 58 and 62.

The vehicle may have a wireless receiver 68 that receives wireless control signals from a transmitter 70. The motors 56 and receiver 68 may be powered by a battery pack 72 enclosed by a housing lid 74. The battery pack 72 may be recharged in a battery pack recharger 76.

The vehicle may include a ramp lift assembly 78 that lifts the platform 52. The platform 52 is pivotally connected to the top housing 50 by a pin 80. The platform 52 may include a rubber band or spring catapult 82 that is coupled to the ramp lift assembly 78. The catapult 82 rolls about a pulley 84 coupled to the platform by pins 86. The vehicle may also have a contact assembly 88.

The airplane may include a pair of motorized propeller assemblies 90 attached to a housing 92. The housing 92 includes a tail 94. The motorized propellers 90 are coupled to a battery pack 96 that is also coupled to a wireless receiver 98. The wireless receiver 98 receives wireless control signals from the wireless transmitter 70. The battery pack 96 can be housed within a battery housing 100 of the plane. The plane may further have a hook and contact assembly 102 attached to the housing. The hook is attached to the catapult 82. The contact is attached to the contact assembly 88 of the vehicle. The motorized propeller 90 may be coupled to a switch 104 that can be used to turn off the airplane. The switch 104 can also turn off the motors 56 when the plane is loaded onto the vehicle.

In operation, the user transmits control signals to the vehicle receiver 68 from the transmitter 70 to control movement of the vehicle. The user may transmit a control signal that causes the platform lift 78 to lift the platform 52 and rotate the catapult 82 to launch the airplane. The lack of connection between the contacts 88 and 102 turns off the vehicle motors 56 and turns on the airplane motorized propellers 90. The user can then control the flight of the airplane through the wireless transmitter 70.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, although an airplane configured powered projectile is shown and described, it is to be understood that the projectile may have other configurations such as a helicopter, missile or rocket. Additionally, the remote controlled vehicle may have other configurations such as a hovercraft or a boat. Although the powered projectile is described as powered by a battery and motor the projectile may have other means for powering the projectile such as a spring or rubber band. Additionally, the airplane may be launched by mere activation of the motorized propeller without use of a catapult.

Furthermore, the airplane shaped projectile may not be powered. In such an embodiment the airplane is initially projected by the launch mechanism and then glides through the air. This is distinct from prior art toys that launch missile projectiles which merely fly along a trajectory path.

What is claimed is:

1. A remote controlled toy set, comprising:

a remote controlled vehicle that has a launch mechanism;

a powered projectile that is coupled to said launch mechanism of said remote controlled vehicle; and, a remote controlled transmitter that is wirelessly coupled to said remote controlled vehicle and wirelessy coupled to said powered projectile to control movement of said remote controlled vehicle and separately control movement of said power projectile.

2. The toy set of claim 1, wherein said powered projectile is remote controlled by said remote controlled transmitter.

3. The toy set of claim 2, wherein said powered projectile is configured as a toy airplane that contains a power source and a motor controlled through said remote controlled transmitter.

4. The toy set of claim 2, wherein said remote controlled transmitter provides a launch signal that launches said powered projectile.

5. The toy set of claim 1, wherein said launch mechanism includes a catapult.

6. The toy set of claim 1, wherein said remote controlled transmitter controls said remote controlled vehicle before said powered projectile is launched by said launch mechanism and controls said powered projectile after said powered projectile is launched by said launch mechanism.

7. The toy set of claim 1, wherein said remote controlled vehicle and said powered projectile each have contacts for sensing separation between said powered projectile and said remote controlled vehicle.

8. The toy set of claim 1, wherein said remote controlled vehicle includes a motor and a power source.

9. The toy set of claim 1, wherein said powered projectile includes a motor and a power source.

10. The toy set of claim 1, wherein said remote controlled vehicle and said powered projectile each include a receiver that receives control signals at different frequencies.

11. A remote controlled toy set, comprising:

a remote controlled vehicle;

a remote controlled projectile coupled to said remote controlled vehicle; and a remote controlled transmitter that is wirelessly coupled to said remote controlled vehicle and said remote controlled projectile to control movement of said remote controlled vehicle and separately control movement of said remote controller projectile.

12. The toy set of claim 11, wherein said remote controlled vehicle includes launch means for launching said remote controlled projectile from said remote controlled vehicle.

13. The toy set of claim 12, wherein said remote controlled transmitter controls said remote controlled vehicle before said powered projectile is launched by said launch means and controls said powered projectile after said powered projectile is launched by said launch means.

14. The toy set of claim 12, wherein said powered projectile is configured as an airplane that contains a power source and a motor controlled through said remote controlled transmitter.

15. The toy set of claim 11, wherein said remote controlled vehicle and said powered projectile each have contacts for sensing separation between said powered projectile and said remote controlled vehicle.

16. The toy set of claim 11, wherein said remote controlled vehicle includes a motor and a power source.

17. The toy set of claim 11, wherein said powered projectile includes a motor and a power source.

18. The toy set of claim 11, wherein said remote controlled vehicle and said powered projectile each include a receiver that receives controls at different frequencies.

19. The toy set of claim 18, wherein said remote controlled transmitter provides a launch signal that launches said powered projectile.

20. A remote controlled toy set, comprising:

a remote controlled vehicle that has a launch mechanism;

a toy airplane that is coupled to said launch mechanism of said remote controlled vehicle; and, a remote controlled transmitter that is wirelessly coupled to said remote controlled vehicle and wirelessly coupled to said toy airplane to control movement of said remote controlled vehicle and separately control movement of said toy airplane.

21. The toy set of claim 20, wherein said launch mechanism includes a catapult.

22. The toy set of claim 20, wherein said remote controlled vehicle includes a motor and a power source.

23. The toy set of claim 20, wherein said remote controlled transmitter provides a launch signal that launches said toy airplane.

* * * * *

UNITED STATES PATENT AND TRADEMARK OFFICE

CERTIFICATE OF CORRECTION

PATENT NO. : 7,018,264 B2
APPLICATION NO. : 10/636165
DATED : March 28, 2006
INVENTOR(S) : George T. Foster et al.

It is certified that error appears in the above-identified patent and that said Letters Patent is hereby corrected as shown below:

In the Specification

Col. 1, line 46, change “controlled” to “control”

In the Claims

Claim 1, col. 4, line 14, change “controlled transmitter” to “control transmitter”

Claim 1, col. 4, line 15, change “wirelessy” to “wirelessly”

Claim 2, col. 4, line 20, change “controlled transmitter” to “control transmitter”

Claim 3, col. 4, lines 23-24, change “controlled transmitter” to “control transmitter”

Claim 4, col. 4, lines 25-26, change “controlled transmitter” to “control transmitter”

Claim 6, col. 4, lines 30-31, change “controlled transmitter” to “control transmitter”

Claim 11, col. 4, line 50, change “controlled transmitter” to “control transmitter”

Claim 13, col. 4, lines 59-60, change “controlled transmitter” to “control transmitter”

Claim 14, col. 4, lines 66-67, change “controlled transmitter” to “control transmitter”

Claim 19, col. 5, lines 12-13, change “controlled transmitter” to “control transmitter”

Claim 20, col. 6, line 3, change “controlled transmitter” to “control transmitter”

Claim 23, col. 6, lines 12-13, change “controlled transmitter” to “control transmitter”

Signed and Sealed this
Eighth Day of July, 2014

Michelle K. Lee

Michelle K. Lee
*Deputy Director of the United States Patent and Trademark Office*